United States Patent [19]

Larson

[11] 4,243,852

[45] Jan. 6, 1981

[54] MEMBRANE SWITCH WITH MEANS FOR IMPEDING SILVER MIGRATION

[75] Inventor: Willis A. Larson, Crystal Lake, Ill.

[73] Assignee: Oak Industries Inc., Crystal Lake, Ill.

[21] Appl. No.: 30,470

[22] Filed: Apr. 16, 1979

[51] Int. Cl.[3] ..... H01H 13/70

[52] U.S. Cl. ..... 200/5 A; 200/159 B; 200/267

[58] Field of Search ..... 200/5 A, 159 B, 262, 200/267, 270

[56] References Cited

U.S. PATENT DOCUMENTS

| | | | |
|---|---|---|---|
| 3,705,276 | 12/1972 | Seeger, Jr. et al. | 200/5 A |
| 4,035,593 | 7/1977 | Riniker | 200/5 A |
| 4,065,649 | 12/1977 | Carter et al. | 200/159 B X |
| 4,143,253 | 3/1979 | Wagner et al. | 200/5 A |

*Primary Examiner*—James R. Scott

*Attorney, Agent, or Firm*—Kinzer, Plyer, Dorn & McEachran

[57] ABSTRACT

A membrane switch has a first silver conductor formed on a flexible membrane and a second silver conductor formed on a substrate, which may also be a flexible membrane. A spacer is positioned between and adhesively secured to the substrate and membrane in such a way that there is an opening in the spacer in register with the first and second conductors. Pressure applied to the membrane moves it toward the substrate through the opening in the spacer to cause electrical contact between the first and second conductors. There are means for impeding migration of the silver between the first and second conductors which essentially consists of orienting the conductors so as to provide the longest possible path between portions thereof.

11 Claims, 3 Drawing Figures

MEMBRANE SWITCH WITH MEANS FOR IMPEDING SILVER MIGRATION

SUMMARY OF THE INVENTION

The present invention relates to membrane switches utilizing silver conductors and in particular to a means for impeding migration of the silver to the point where there is a short between normally open conductors.

One purpose is a membrane switch in which silver may be screened or painted, in conductive paths, on spaced surfaces of the switch, and wherein the switch configuration impedes silver migration to the point where it will not affect the useful life of the switch.

Another purpose is a switch of the type described in which the conductors are so oriented, one to another, as to provide the longest possible path for silver migration therebetween.

Another purpose is a switch of the type described in which carbon is applied over one or more silver conductive areas to increase contact area.

Another purpose is a switch of the type described wherein the silver conductors are buried in a high impedance resin system to prevent moisture formation.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
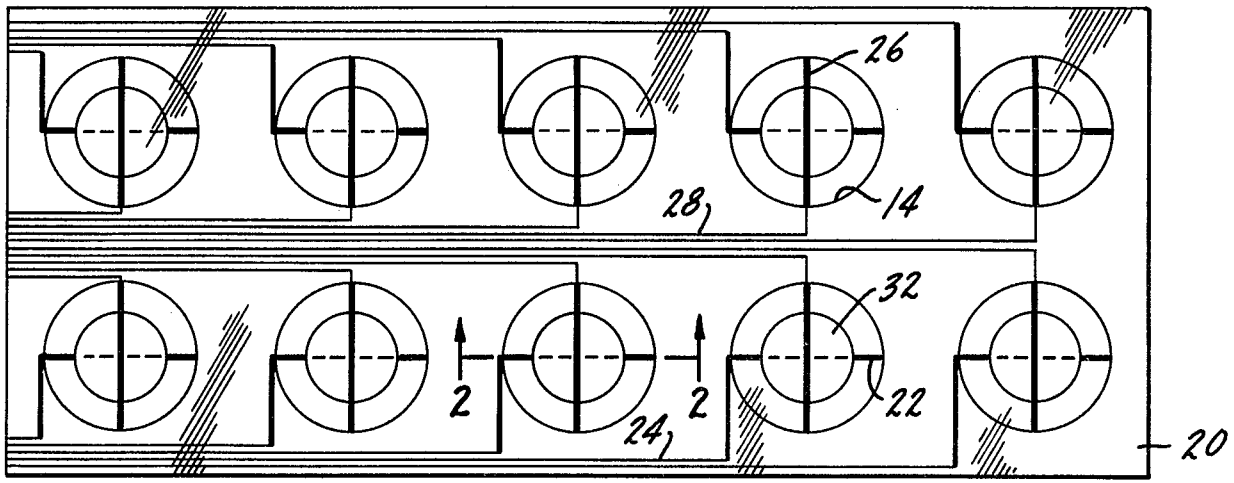
FIG. 1 is a diagrammatic top view of a switch of the type described.

The present invention concerns membrane switches of the type generally shown in my prior U.S. Pat. Nos. 3,988,551 and 4,017,697, as well as several similar patents relating to the same subject matter. With the introduction of microprocessors and other sophisticated relatively inexpensive electronics, switching functions can now be reduced to the opening and closing of contacts permitting a simplified and more reliable switch construction. The membrane switch disclosed herein is specifically directed to this concept wherein there is only an opening and closure of a switch contact with more sophisticated switching functions being carried on by the auxiliary electronics.

One method of making an economical membrane switch uses conductors which are painted, printed or silkscreened onto one or more adjacent surfaces, customarily the supporting substrate and the movable membrane. In this connection, although the present application will disclose a membrane switch in which the supporting substrate, is also a flexible membrane, it should be understood that the principles disclosed herein are equally applicable to a membrane switch in which the substrate is rigid. Because of its high electrical conductivity, silver is a very desirable conductive metal which may be painted, printed or silkscreened onto a surface. Other metals of the non-noble type either do not normally remain conductive after they have been painted on a supporting surface or are poor conductors. Silver, on the other hand, remains conductive, but has the serious drawback that the silver particles will tend to migrate from the anode to the cathode and ultimately a high impedance short may be formed between normally separate conductors or elements. The present invention is particularly directed to a means for impeding the formation of such a high impedance short to the point where what silver migration does take place does not affect the useful life of the switch.

The phenomenon of silver migration has long been known and has been extensively documented in numerous publications over the last 30 years. Essentially, migration takes place when there is a potential difference between spaced silver conductors and there is sufficient humidity, normally a continuous moisture film, to permit the metal silver to be ionized to positive silver ions. Normally the following chemical reaction takes place:

$$2AG^{+}+2OH^{-}\rightarrow 2AG(OH)\rightarrow AG_2O+H_2O$$

In essence, the metallic silver is changed to a silver hydroxide which is soluble in water. Silver then deposits in the vicinity of the cathode due to the voltage potential. The migration is from the anode to the cathode, but the dendrites that are formed grow from the cathode toward the anode. In the case of an alternating potential, the dendrites will be formed from both conductors toward each other.

The growth of the dendrite in silver migration can be extremely rapid under conditions of sufficiently high applied voltage and substantial humidity. At times only a few minutes or even seconds are necessary to complete a short between two spaced conductors, where the spacing is small.

Various solutions have been presented to prevent silver migration. One suggestion is to seal the entire switch construction so as to prevent moisture from forming inside of the switch in the area of the silver conductors. However, it has been determined that such a seal is not always practical, as the plastic films used in the switch construction will, over a period of time, transfer the exterior humidity to the interior due to their permeability. For example, 0.005-inch thick Mylar at 38° C. will transmit water vapor at the rate of 0.3 grams per 100 square inches of surface area exposed per 24 hours, and hydrogen sulfide at the rate of 4 cubic centimeters per 100 square inches of surfaces area exposed per 24 hours per atmosphere of pressure. In addition, in some situations sealing a switch creates other problems, changes in atmospheric pressure can cause the force required to actuate the switch to vary substantially from the time of manufacture, depending on barometric pressure and temperature.

Although silver has been in substantial use in electronics for a long period of time, the problem of silver migration has not been of a nature as to eliminate silver as a conductor. In television normally the heat of the various components eliminates any moisture. In other areas the component may normally have a short useful life and is designed to be replaced after a period of time. However, in membrane switches of the type which must have a life permitting several million operating cycles and which will be in use for several years, silver migration can be a problem. The present invention recognizes the fact of silver migration, but provides means for impeding such migration to the point where it will not affect the useful life of the switch. Thus, although there may be migration, it will take such a sufficient period of time, that it will not materially affect the life of the switch in its particular application.

Figure 2:
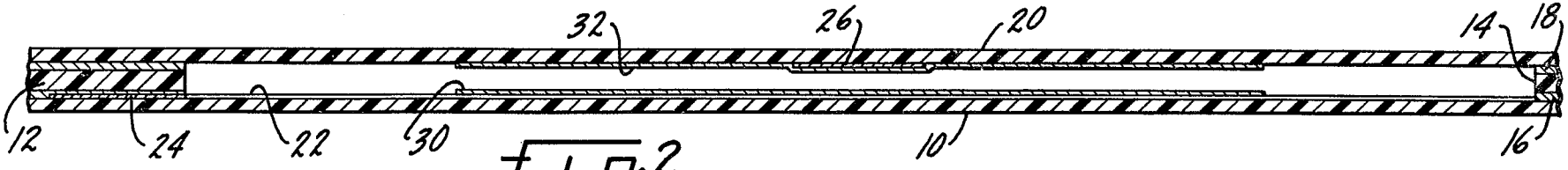
FIG. 2 is an enlarged section along plane 2—2 of FIG. 1.

In FIGS. 1 and 2, the diagrammatic illustration of a membrane switch includes a substrate 10 which may be flexible. A spacer 12 having a series of spaced openings 14 is secured by an adhesive layer 16 to the substrate 10 and is secured by a second adhesive layer 18 to a flexible membrane 20. The adhesive and membranes may be formed of conventional materials.

Looking specifically at FIG. 1, a series of first conductors 22 may be painted or otherwise applied to the substrate 10 and will be formed of silver. Each of these conductors may have individual conductive leads, similarly formed of silver, indicated at 24, which terminate at a common point adjacent one area of the substrate 10. Normally the conductive leads 24 will be on a tail which extends outwardly from the substrate providing an interconnection to the electronic circuit.

In like manner, silver conductors 26 are formed on the underside of membrane 20 and each of the conductors 26 may have conductive leads 28, formed of silver, which terminate at a common point on the membrane 20. Again, such conductive leads may terminate on a tail.

Because the silver conductors 22 and 26 can be quite thin, for example 0.050 inch in width, it is often desirable to have a greater area for contact to insure a good electrical connection and ease of actuation. Thus, each of the conductors 22 may have a spot 30 formed thereon, which spots may be formed of a non-migrating material such as carbon, which has an electrical conductivity lower than silver. The spots are in register or alignment with similar carbon spots 32 formed upon conductors 26. The carbon spots 30 and 32 may, for example, have a diameter of 0.3 to 0.4 inch, assuming that opening 14 has a diameter of 0.5 inch. The spots or carbon areas may be painted upon the silver conductors after the conductors have first been applied to the substrate and membrane. Not only do the carbon spots provide increased area for electrical contact between the conductors, but as carbon does not migrate there is no problem of the carbon causing a short between the conductors.

In the construction of FIGS. 1 and 2, the principal means for impeding migration of the silver between the two conductors is the orientation of the conductors such that they are generally mutually perpendicular, thus providing maximum separation between conductors. Assuming a conductor width of 0.05 inch, an opening in the spacer of 0.5 inch and a spacer height of 0.007 inch, the path of migration is 0.232 inch. This is to be contrasted with a path which is essentially the thickness of the spacer (0.007 inch) if the conductors were parallel with each other or both formed along the same diameter. It can be seen that the described orientation provides a substantial impediment to the migration of silver due to the increase in spacing between conductors.

Figure 3:
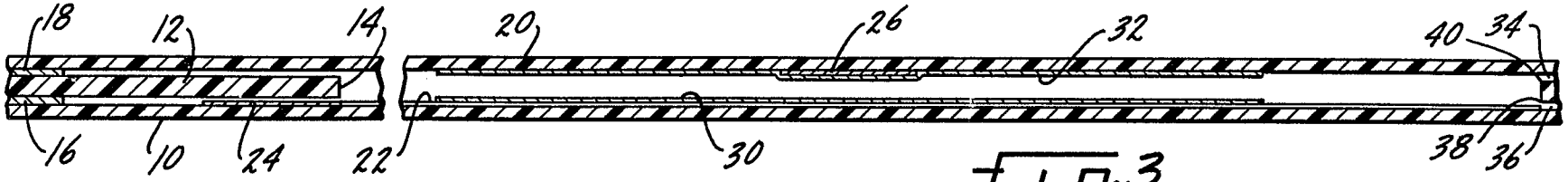
FIG. 3 is an enlarged section, similar to FIG. 2, but showing a modified form of switch.

FIG. 3 shows a modified form of the invention providing a further impediment to silver migration. Like parts have been given like numbers. Although carbon spots are shown in FIG. 3, that may not be the case in every application. The principal structural feature of FIG. 3 are the recesses 34 and 36 formed between membrane 20 and spacer 12 and substrate 10 and spacer 12, respectively. The recesses are formed by eliminating adhesive layers 16 and 18 in the areas directly adjacent opening 14. Thus, the spacer in effect extends into the opening, but has no adhesive support directly adjacent the opening. The lack of adhesive provides small gaps which may be circumferential, or may be otherwise. What is important is the substantial addition to the length of the path for silver migration caused by the gaps. Assuming that the adhesive layers have a thickness of 0.001 inch and have a radial dimension of 0.100 inch, the path of silver migration has been increased by 0.400 inch to 0.632 inch.

By proper switch spacing, the elimination of such a small amount of adhesive will have no effect upon the integrity of the overall switch, adequate adhesive area is provided to completely secure the membrane to the spacer and the substrate to the spacer. However, the provision of such a space clearly adds to the length of the path for silver migration. In addition, the path of migration now requires the traversing of two sharp corners on the spacer indicated at 38 and 40. Not only is it unlikely that moisture will be able to form around such sharp corners, thereby substantially reducing the possibility of the silver migrating beyond those points, but the spacer portion which hangs out over the adhesive will in all likelihood flex to some minor degree during operation of the switch. Such flexing can damage or fracture any silver migration conductor which has been formed around the spacer. Thus, not only has the path been lengthened, but the likelihood of the silver effectively migrating about such a movable and somewhat torturous path is remote.

The invention should not be limited to any specific dimensions nor to any specific material for the membrane or substrate. Although the substrate has been described as being flexible, it could be rigid. What is important is to provide impediments in the path of silver migration between the two normally spaced conductors. As indicated above, such migration requires a voltage differential and humidity. The impediments to migration essentially consist in lengthening the path over which the silver particles must travel in order to form a conductive short between the two spaced conductors. Not only is the path lengthened, but there are obstructions in the path in the nature of sharp irregular corners which will not readily support moisture. Also, the spacer may have some flexibility during operation which will further prevent the formation of a solid conductor path between the normally spaced conductors.

Whereas the preferred form of the invention has been shown and described herein, it should be realized that there may be many modifications, substitutions and alterations thereto.

The embodiments of the invention in which an exclusive property or privilage is claimed are as follows:

1. In a membrane switch, a substrate, a first silver conductor formed on said substrate, a flexible membrane, a second silver conductor formed on said membrane, a spacer positioned between said substrate and membrane, an opening in said spacer in register with said first and second conductors, said membrane moving toward said substrate through said opening to cause contact between said first and second conductors in response to pressure upon the exterior of said membrane, and means for impeding migration of silver between said first and second conductors by maximizing the silver migration path therebetween.

2. The membrane switch of claim 1 further characterized in that said substrate is a flexible material.

3. The membrane switch of claim 1 further characterized in that said first and second conductors are generally mutually perpendicular.

4. The membrane switch of claim 3 further characterized by and including a conductive area formed of a lower conductivity non-migrating material formed on at least one of said first and/or second conductors, said conductive area being generally centrally located relative to said opening.

5. The membrane switch of claim 4 further characterized by and including conductive areas on both said first and second conductors, with said conductive areas being generally in register, one with another.

6. The membrane switch of claim 1 further characterized in that said spacer is adhesively secured to said substrate and membrane.

7. The membrane switch of claim 6 further characterized by and including a recess formed between said substrate and spacer adjacent said opening by elimination of adhesive, to lengthen the path of migration between said first and second conductors.

8. The membrane switch of claim 6 further characterized by and including recesses formed between said substrate and spacer and membrane and spacer adjacent said opening by elimination of adhesive to lengthen the path of silver migration between said first and second conductors.

9. The membrane switch of claim 8 further characterized in that said recesses extends circumferentially about said opening.

10. The membrane switch of claim 6 further characterized by and including a recess formed between said membrane and spacer adjacent said opening by elimination of adhesive, to lengthen the path of migration between said first and second conductors.

11. In a membrane switch, a substrate, a first silver conductor formed on said substrate, a flexible membrane, a second silver conductor formed on said membrane, a spacer positioned between said substrate and membrane, an opening in said spacer in register with said first and second conductors, said first and second conductors being so oriented, one to another in the area of an opening, as to provide the longest path between portions thereof, thereby impeding migration of silver therebetween.

* * * * *